US011498741B2

(12) United States Patent
Tsubouchi et al.

(10) Patent No.: US 11,498,741 B2
(45) Date of Patent: Nov. 15, 2022

(54) CUSHIONING FOR AIRBLOWER

(71) Applicant: Panasonic Intellectual Property Management Co., Ltd., Osaka (JP)

(72) Inventors: Masafumi Tsubouchi, Aichi (JP); Daisuke Kanematsu, Aichi (JP); Shogo Maeda, Aichi (JP); Yuto Masuda, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 17/196,266

(22) Filed: Mar. 9, 2021

(65) Prior Publication Data

US 2022/0289455 A1 Sep. 15, 2022

(51) Int. Cl.
*B65D 81/113* (2006.01)
*B65D 85/68* (2006.01)

(52) U.S. Cl.
CPC ..... *B65D 81/113* (2013.01); *B65D 85/68* (2013.01); *B65D 2581/053* (2013.01); *B65D 2585/6807* (2013.01)

(58) Field of Classification Search
CPC ..... B65D 81/02; B65D 81/05; B65D 81/053; B65D 81/07; B65D 85/68; B65D 2585/6802; B65D 81/113
USPC ..... 206/588, 591, 592, 594
See application file for complete search history.

(56) References Cited

U.S. PATENT DOCUMENTS

| | | | | |
|---|---|---|---|---|
| 5,024,328 A * | 6/1991 | Bontrager | B65D 81/107 | 206/453 |
| 6,082,543 A * | 7/2000 | Beliveau | B65D 81/022 | 206/523 |
| 6,405,866 B2 * | 6/2002 | Arima | B65D 81/05 | 206/453 |
| 7,086,534 B2 * | 8/2006 | Roesel | B65D 5/5028 | 206/583 |
| 2003/0173249 A1 * | 9/2003 | Nemoto | B65D 5/5038 | 206/592 |

FOREIGN PATENT DOCUMENTS

| | | | | |
|---|---|---|---|---|
| GB | 1419168 A * | 12/1975 | B65D 81/107 | |
| JP | 2002-160792 A | 6/2002 | | |

* cited by examiner

*Primary Examiner* — Bryon P Gehman
(74) *Attorney, Agent, or Firm* — Renner, Otto, Boisselle & Sklar, LLP

(57) ABSTRACT

A cushioning, which is used for packaging an embedded air blower, forms a three-dimensional shape which partially coincides with a shape of the embedded air blower in a packaged state. The cushioning is capable of forming a planar plate shape in an unpackaged state. The cushioning includes a slit which coincides with an outer periphery of an embedding hole for embedding the embedded air blower, in the planar plate shape.

7 Claims, 10 Drawing Sheets

CUSHIONING FOR AIRBLOWER

BACKGROUND

1. Technical Field

The present disclosure relates to a cushioning used for packaging an embedded air blower.

2. Description of Related Art

For example, when an embedded air blower, such as a fan, is stored or transported, the embedded air blower is packaged in a cushioning for storage.

As this type of cushioning, for example, a package for a fan as disclosed in Japanese Unexamined Patent Application Publication No. 2002-160792 is conventionally known. Hereinafter, the package will be described with reference to FIG. 10 and FIG. 11.

The package forms single packaging material 200 having a rectangular plate shape in a developed state as illustrated in FIG. 10. The package includes, as illustrated in FIG. 11, five peripheral walls 201*a* to 201*e* which serve as a tubular outer packaging with a substantially rectangular cross-section, and four folds 200*a* for forming peripheral walls 201*a* to 201*e*. The package further includes slits 202*a* and 203*a* for erecting fan holders 202 and 203 which support fan 100 from two opposing directions of fan 100 by separating part of the peripheral walls from peripheral walls 201*a* to 201*e*.

In the package, the outer periphery of fan 100 is held by fan holders 202 and 203 to separate fan 100 from peripheral walls 201*a* to 201*e*. This prevents impact to peripheral walls 201*a* to 201*e* from directly transmitting to fan 100, leading to protection of fan 100, that is, a product.

Moreover, according to the conventional technique, before the package is folded for assembly, the package is a single packaging material having a substantially rectangular shape. Hence, the efficiency for cutting out the packaging material from a large base material is high. Additionally, since the package which is once opened and then is made into a developed state again is a single packaging material with a substantially rectangular shape, only a small storage space is required. Moreover, it is easy to reassemble and reuse the package, leading to a high recyclability.

SUMMARY

Such a cushioning devised in consideration with disposal aspect as well is conventionally available. However, after the cushioning functions as a package for protecting a product at the time of transport, there is no other use for it except to be disposed, leading to a low usability.

The present disclosure has been conceived to solve the conventional problem. An object of the present disclosure is to provide a cushioning with an increased usability.

In order to achieve the object, a cushioning according to the present disclosure is a cushioning used for packaging an embedded air blower. The embed air blower is embedded in a hole in a surface on which the embed air blower is to be installed. In a packaged state of the embedded air blower, the cushioning forms a three-dimensional shape which partially coincides with the shape of the air blower. In an unpackaged state of the embedded air blower, the cushioning is capable of forming a planar plate shape. The cushioning includes a slit which coincides with an outer periphery of an embedding hole for embedding the embedded air blower, in the planar plate shape. With such features, an expected object is achieved.

According to the present disclosure, a cushioning has an additional function which can be used at the time of installation of a product, leading to an increased usability.

DETAILED DESCRIPTION

Figure 1:
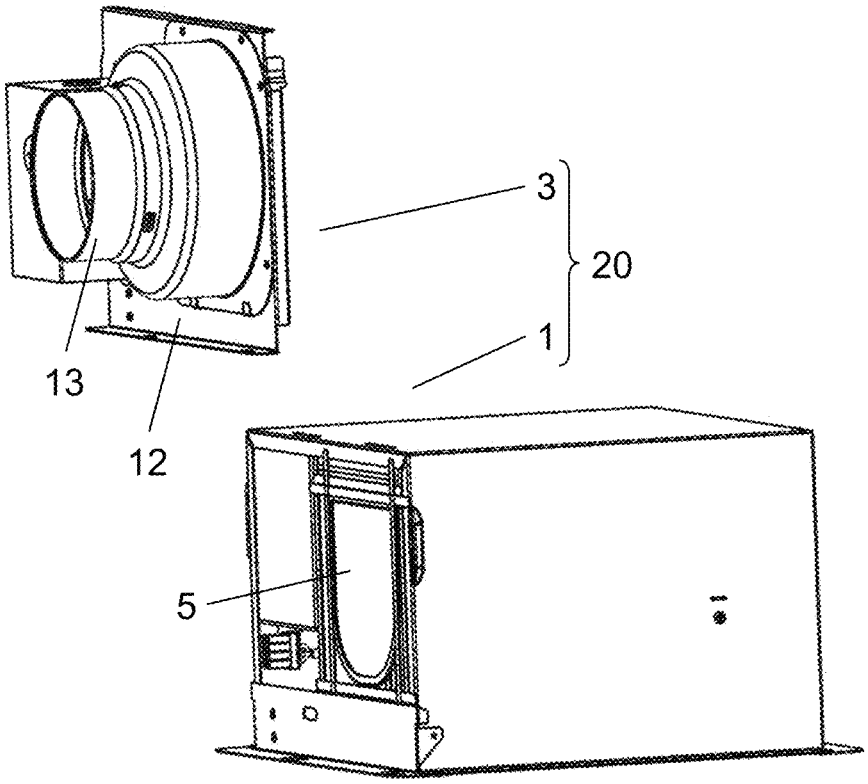
FIG. 1 is an exploded perspective view of an embedded air blower.

Hereinafter, an embodiment of the present disclosure will be described with reference to the drawings. The following embodiment is an example embodying the present disclosure, and does not limit the technical scope of the present disclosure. Throughout the drawings, the same elements are denoted by the same reference numerals, and the second and subsequent descriptions thereof are omitted. In addition, in each drawing, the description of the details of each element which is not directly related to the present disclosure is omitted.

Embodiment 1

First, a configuration of embedded air blower 20 will be described with reference to FIG. 1 and FIG. 2. FIG. 1 is an exploded perspective view of embedded air blower 20, and FIG. 2 is a bottom view of embedded air blower 20.

Figure 2:
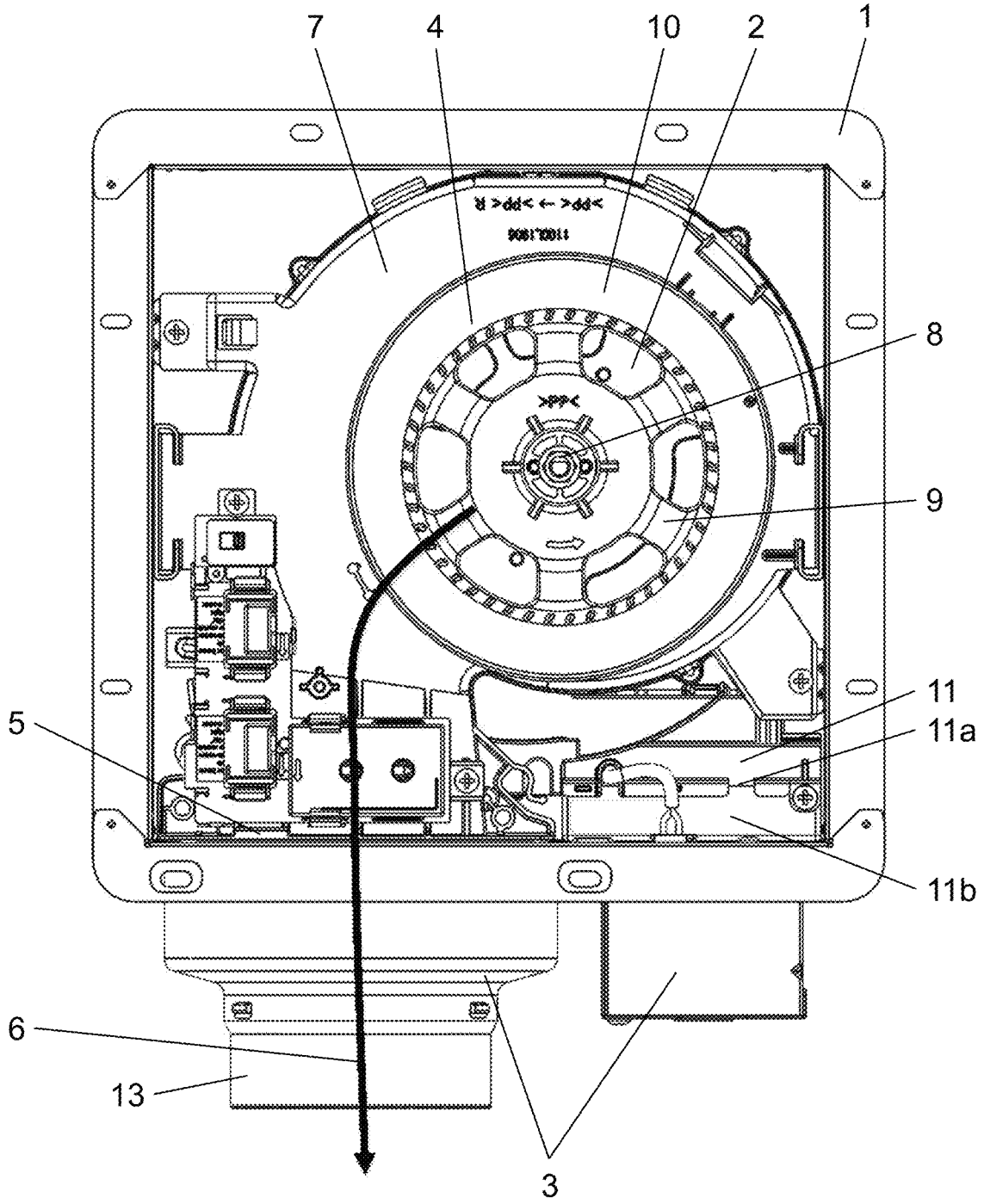
FIG. 2 is a bottom view of the embedded air blower.

As illustrated in FIG. 1 and FIG. 2, embedded air blower 20 includes housing 1, air blowing unit 2, and adaptor 3.

Housing 1 has a box shape with a bottom surface and at least one side surface which have openings. Housing 1 is made of metal or resin. Housing 1 includes inlet 4 in the lower surface and outlet 5 in the side surface to which adaptor 3 is mounted.

Inlet 4 is disposed in the bottom surface of housing 1 facing in a direction from the ceiling toward the ground, that is, vertically downward, in a state where embedded air blower 20 is installed in the ceiling while the lower surface of embedded air blower 20 coincides with the surface of the ceiling plate. In other words, the opening of the bottom surface of housing 1 corresponds to inlet 4. Intake of air to the inside of housing 1 is performed via design panel 21 with a lattice structure (to be described later) disposed over the opening of the bottom surface of housing 1.

Outlet 5 is disposed as an opening in one side surface of housing 1 adjacent to the bottom surface with inlet 4, that is, in one side surface of housing 1 to which adaptor 3 is mounted.

Inlet 4 and Outlet 5 are in communication with each other inside housing 1, and the communicating air passage forms exhaust air passage 6.

Air blowing unit 2 is disposed in exhaust air passage 6, and guides air from inlet 4 to outlet 5. Air blowing unit 2 includes casing 7, motor 8, and fan 9.

Casing 7 forms the shape of air blowing unit 2, and is made of resin. Casing 7 has a substantially cylindrical shape. The bottom surface of casing 7 positioned on the lower surface includes an opening for drawing in air and the side surface of casing 7 includes an opening for exhausting air. The opening of the bottom surface of casing 7 is positioned in proximity to inlet 4 of housing 1, and the opening of the side surface of casing 7 is connected to outlet 5 of housing 1. The cross section of casing 7 parallel to the bottom surface of casing 7 has a scroll shape. Casing 7 includes orifice 10 in the opening of the bottom surface.

Orifice 10 has a cylindrical shape, has an opening in the central portion, and is made of resin. The opening of orifice 10 is connected to the opening of the bottom surface of casing 7. Orifice 10 is positioned upstream of the air flow direction of air blowing unit 2, and is fixed to casing 7 by fixing means, such as screws. Orifice 10 may be integrally formed with casing 7.

Motor 8 is disposed on the top side in the internal space of casing 7. Motor 8 is fixed to the portion near the center in the circular scroll shape by fixing means, such as screws. Motor 8 includes a rotary shaft which protrudes from the top surface of casing 7 toward the bottom surface of casing 7. Motor 8 rotates the rotary shaft by power supply. Power supply to motor 8 is performed via an electric board which is not illustrated.

Fan 9 is, for example, a sirocco fan fixed to the rotary shaft of motor 8. Fan 9 is rotated by rotation of the rotary shaft via motor 8, so that air is moved. In other words, driving of air blowing unit 2 guides air from inlet 4 to outlet 5.

An electric board is stored in electric board case 11 disposed in housing 1, and is fixed on the outer side of casing 7 by fixing means, such as screws which are not illustrated.

Electric board case 11 includes electric board base 11*a* made of fire retardant resin and electric board cover lib made of fire retardant resin. The electric board is fixed to electric board base 11*a* by fixing means, such as screws. Electric board cover lib is fixed to electric board base 11*a* by fixing means, such as screws.

Adaptor 3 is disposed on one side surface of housing 1, and on the downstream side of outlet 5. Adaptor 3 includes adaptor plate 12 and duct connector 13.

Adaptor plate 12 is, for example, a flat resin plate having a substantially same size as one side surface of housing 1. Adaptor plate 12 is disposed on the downstream side of one side surface of housing 1 in which outlet 5 is disposed.

Duct connector 13 projects from adaptor plate 12 to the downstream side. The upstream side of duct connector 13 has a rectangular shape and the downstream side of duct connector 13 has a cylindrical shape. The inner space of duct connector 13 is connected to outlet 5 to guide the exhausted air from the inside of housing 1. Duct connector 13 allows exhausted air from embedded air blower 20 to be exhausted to outdoor by, for example, the indoor side end of a duct which communicates the indoor and outdoor being connected to duct connector 13.

Figure 3:
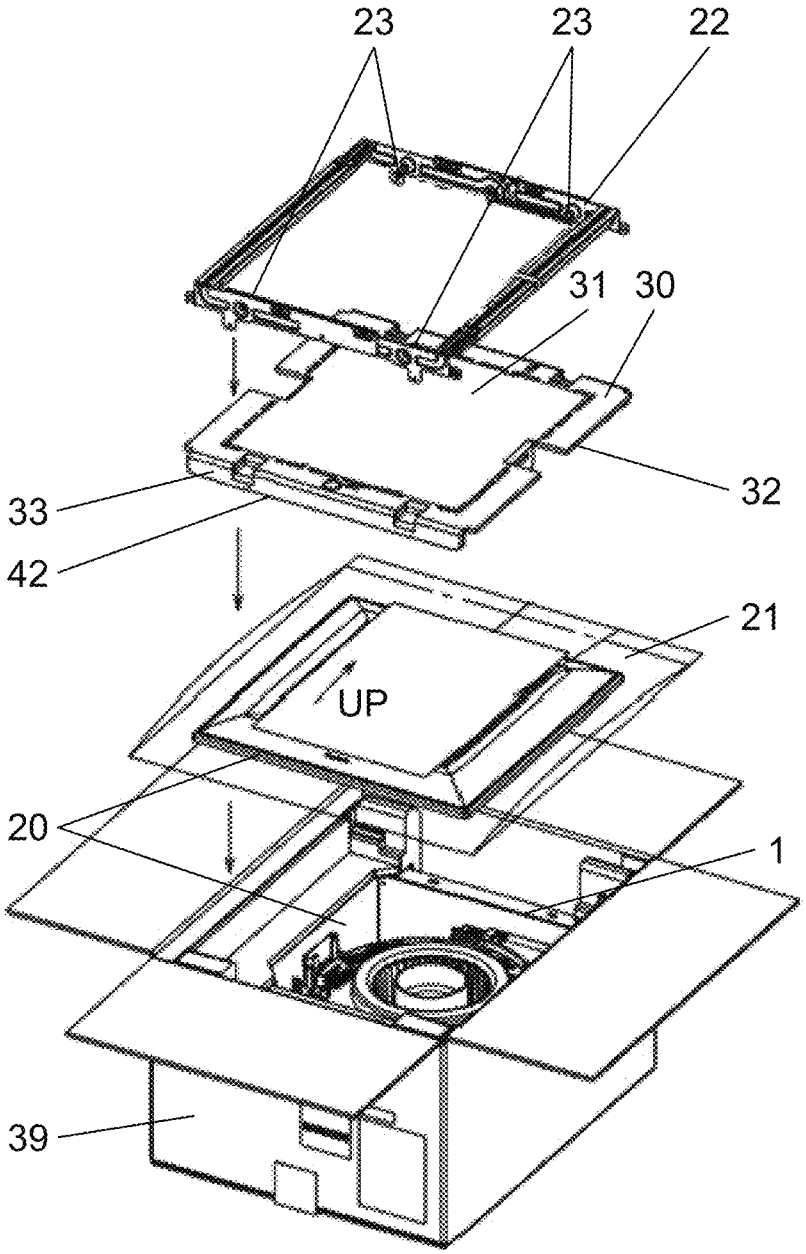
FIG. 3 is an exploded perspective view of an embedded air blower in a packaged state according to Embodiment 1 of the present disclosure.
Figure 4:
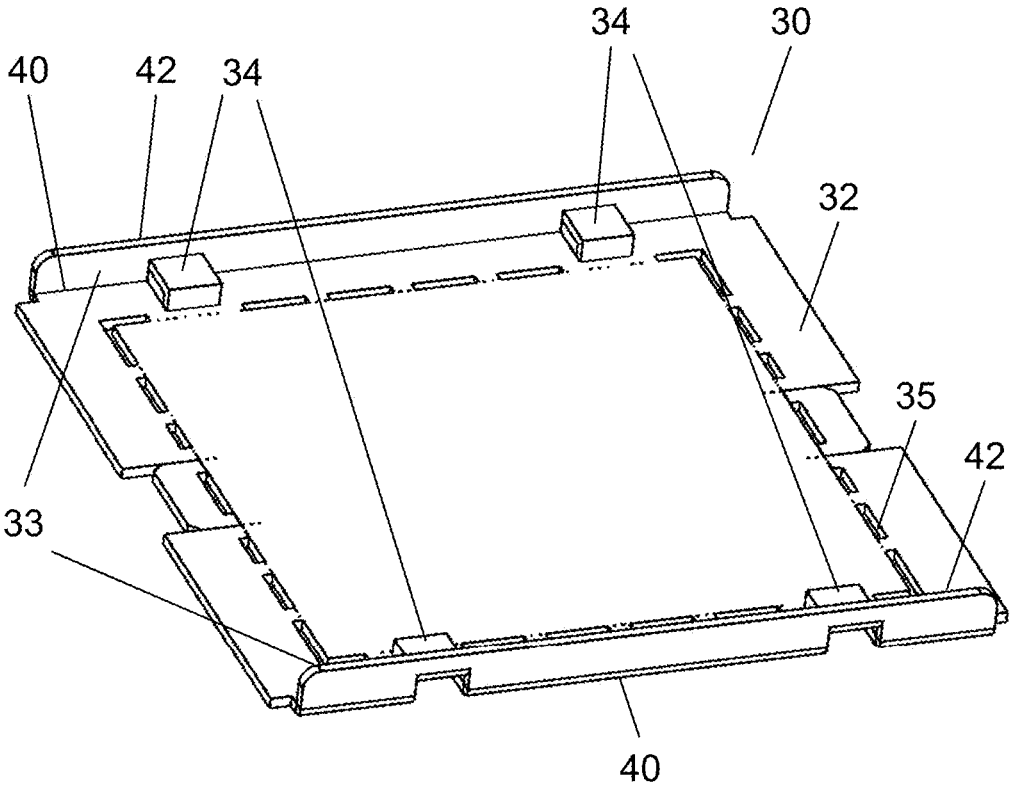
FIG. 4 is a perspective view of a cushioning in the packaged state.
Figure 5:
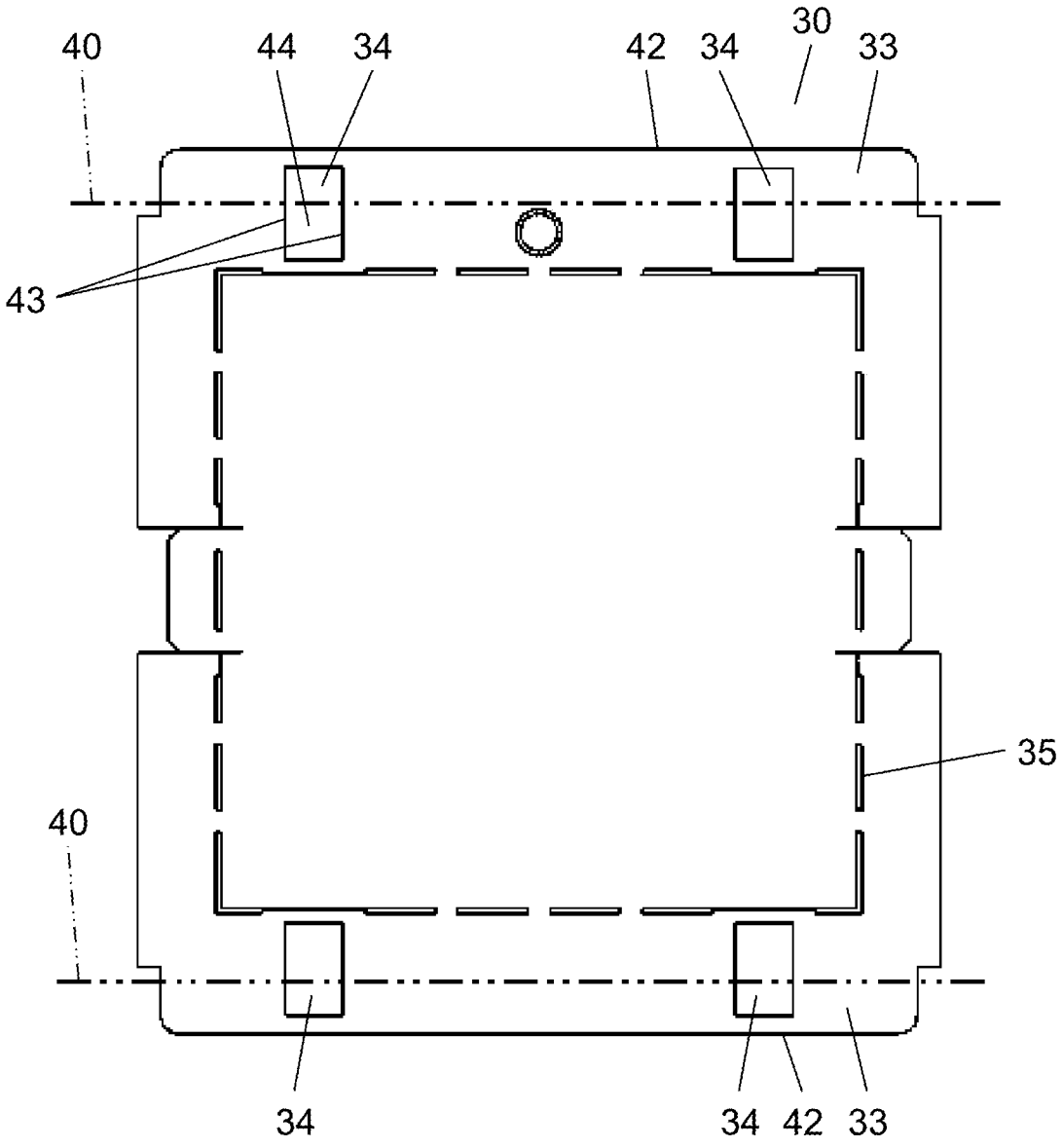
FIG. 5 is a plan view of the cushioning in a developed state.

Next, a packaged state of embedded air blower 20 and a configuration of cushioning 30 will be described with reference to FIG. 3, FIG. 4, and FIG. 5. FIG. 3 is an exploded perspective view of embedded air blower 20 in a packaged state. FIG. 4 is a perspective view of cushioning 30 in the packaged state. FIG. 5 is a plan view of cushioning 30 in a developed state. Here, the term, "developed state" refers to a state where a product, which is embedded air blower 20 here, is not packaged in cushioning 30, that is unpackaged, and refers to a state where the three-dimensional shape to be described later can be flattened out. In other words, it can be said to be an unpackaged state.

Cushioning 30 is used for packaging embedded air blower 20 as illustrated in FIG. 3. Cushioning 30 includes, as a main material, a cardboard which is bendable and which has a certain degree of elasticity. The packaged state of embedded air blower 20 includes cushioning 30, embedded air blower 20, metal fixture 22, and outer case 39.

Design panel 21 has a hollow rectangular shape. The hollow portion has a lattice structure, so that air can be passed therethrough. Design panel 21 is attached over the opening of the bottom surface of housing 1 of embedded air blower 20.

Metal fixture 22 is a hollow rectangular frame which has a function of assisting installation of embedded air blower 20 to the ceiling. Metal fixture 22 includes protrusions 23 protruding from the inner peripheral surface of the frame toward the inner peripheral side of metal fixture 22. Specifically, each of protrusions 23 is a screw before fixation for fixing metal fixture 22 to wooden frame 38 to be described later.

Cushioning 30 has a three-dimensional shape which partially coincides with the shape of a predetermined structural component, such as embedded air blower 20, in the packaged state, as illustrated in FIG. 4. In the unpackaged state illustrated in FIG. 5, cushioning 30 is capable of forming a planar plate shape where the three-dimensional shape is flattened out.

The three-dimensional shape of cushioning 30 includes separators 33 each of which is formed by folding at least part of one side 42 of the planar plate shape in a predetermined angle relative to the plane of the planar plate shape. Specifically, separators 33 are formed by entirely folding both ends of cushioning 30 along folds 40 indicated by the dashed lines in FIG. 5 in 90 degrees toward rear side 32.

Cushioning 30 also includes, on the inner peripheral side relative to separator 33, recesses 34 recessed from front side 31 toward rear side 32. Specifically, each recess 34 is formed by forming two parallel slits 43 leading from separator 33 to the plane of the planar plate shape, and folding and raising portion 44 near the center between two slits 43 in the direction opposite to the direction in which fold 40 is folded.

As illustrated in FIG. 5, cushioning 30 further includes slits 35 which coincide with the outer periphery of embedding hole 36 (to be described later with reference to FIG. 6) disposed on the ceiling for embedding housing 1 of embedded air blower 20, in the planar plate shape. Here, the term "coincides with" does not necessarily mean "strictly coincides with", but also includes a state where slits 35 can draw a larger hole so that housing 1 can be embedded in embedding hole 36 with enough room.

Slits 35 are line-shaped gaps penetrating the plane of the planar plate shape. Slits 35 form a rectangular ring shape with the short sides of the line-shaped gaps being positioned adjacent to each other. The width of each of the short sides of slits 35 is such a width that the tip of pen or pencil 41 can penetrate in view of the purpose. For example, the length of each of the long sides of slits 35 and the distance between the adjacent short sides of slits 35 may be such a length and a distance that do not easily separate the inner portion and the outer portion of the rectangular ring shape. However, it is not preferable that the length of each of the long sides of slits 35 is too short or the distance between adjacent short sides of slits 35 is too long, which makes it difficult to recognize the ring shape.

In a packaged state, as illustrated in FIG. 3, for example, a cushioning material is disposed on the bottom surface of outer case 39, and housing 1 of embedded air blower 20 and adaptor 3 are disposed on the cushioning material. Subsequently, design panel 21 is disposed on top of housing 1, cushioning 30 is disposed on top of design panel 21, and metal fixture 22 is disposed on top of cushioning 30. In other words, a predetermined structural component (first structural component) forming embedded air blower 20, such as design panel 21, is disposed on rear side 32 of cushioning 30 (lower side in FIG. 3). A structural component (second structural component), such as metal fixture 22, different from the predetermined structural component, is disposed on front side 31 of cushioning 30 (upper side in FIG. 3) which is opposite side of rear side 32 of cushioning 30.

In a packaged state, two long edges of separators 33 are disposed on the outer peripheral side of design panel 21, and are disposed in a state where the plane of cushioning 30 is slightly above design panel 21 or in slight contact with design panel 21. Metal fixture 22 is disposed above cushioning 30.

Separators 33 are capable of separating a predetermined structural component (design panel 21) which forms embedded air blower 20 and which is disposed on rear side 32 and on the inner peripheral side of separators 33, and a structural component (meal fitting 22) which is different from the predetermined structural component and which is disposed on front side 31 and on the outer peripheral side of separators 33 or on separators 33.

In such a manner, the plane of the planar plate shape of cushioning 30 separates design panel 21 and metal fixture 22. In other words, the plane of the planar plate shape of cushioning 30 is held by being sandwiched between the predetermined structural component and another structural component different from the predetermined structural component, so that the plane prevents metal fixture 22 made of a hard material from damaging design panel 21 made of a soft material.

In addition, in a packaged state, recesses 34 store, inside recesses 34, protrusions 23 protruding toward the inner peripheral side of the structural component, such as metal fixture 22, which is different from the predetermined structural component, such as design panel 21, so that the structural component can be separated from the predetermined structural component.

Figure 6:
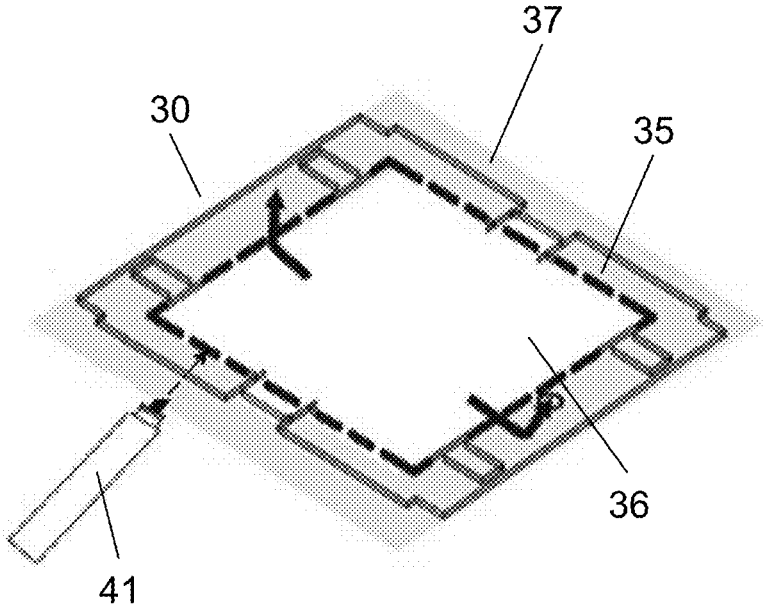
FIG. 6 is a bottom perspective view illustrating how to use the cushioning.
Figure 7:
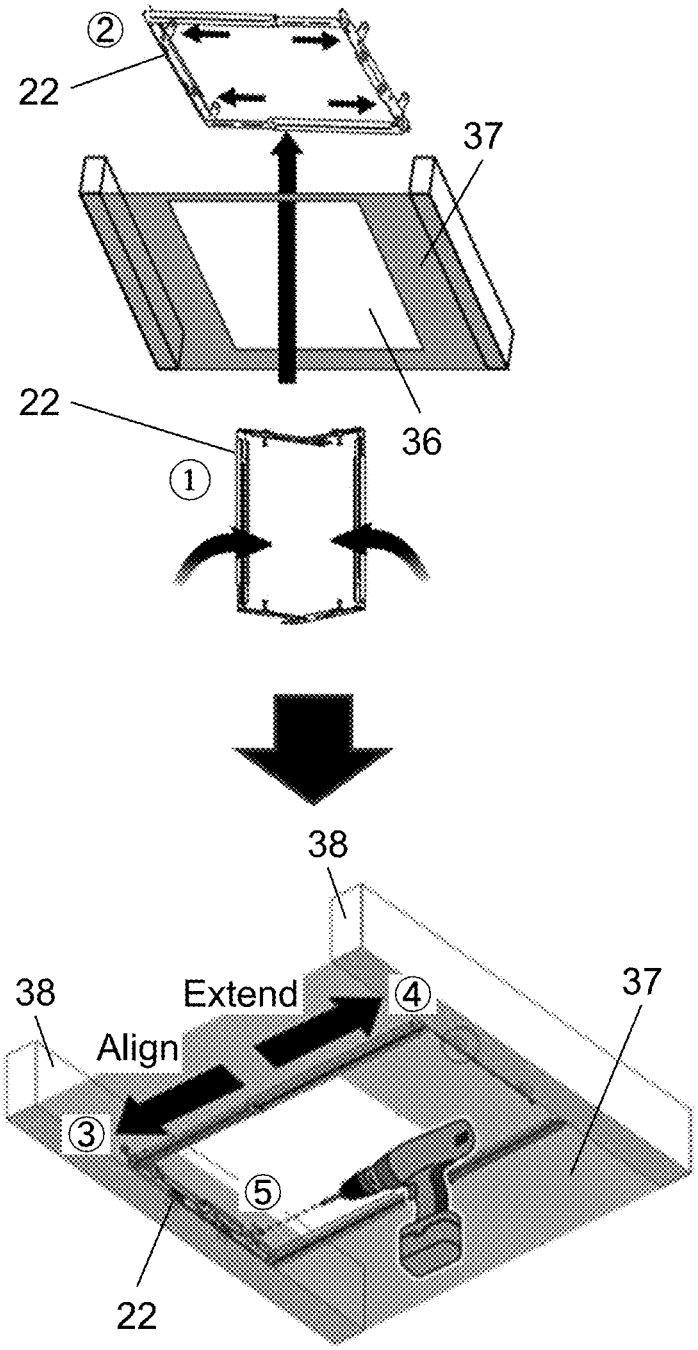
FIG. 7 is a perspective view illustrating how to install a metal fixture.
Figure 8:
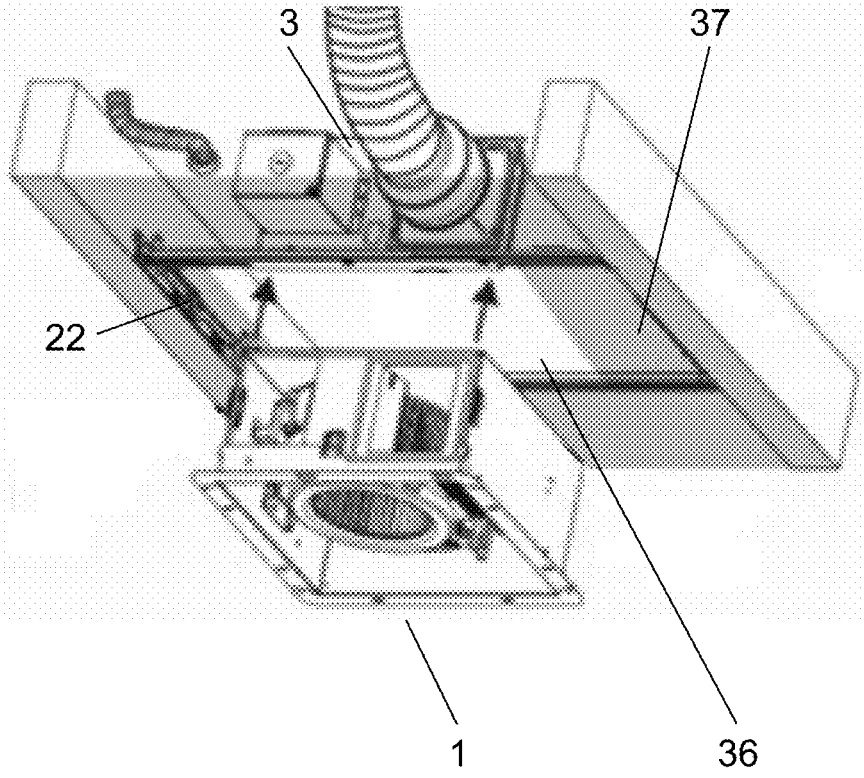
FIG. 8 is a perspective view illustrating how to install the embedded air blower.

Finally, with reference to FIG. 6, FIG. 7, and FIG. 8, how to use cushioning 30 at the time of installation will be described. FIG. 6 is a bottom perspective view illustrating how to use cushioning 30. FIG. 7 is a perspective view illustrating how to install metal fixture 22. FIG. 8 is a perspective view illustrating how to install embedded air blower 20.

First, as illustrated in FIG. 6, a construction worker puts the three-dimensional shape of cushioning 30 which is in an unpacked state back into a planar shape, and presses cushioning 30 against ceiling material 37 to which embedded air blower 20 is to be installed.

Subsequently, the construction worker pushes the tip of pen or pencil 41 into slit 35 of cushioning 30 to draw a ring-shaped indication line along slits 35.

Next, cushioning 30 is removed from the ceiling material 37, and embedding hole 36 is formed along the indication line drawn on ceiling material 37. In other words, embedding hole 36 serves as an opening for installing embedded air blower 20.

Subsequently, as illustrated in FIG. 7, metal fixture 22 is led through embedding hole 36 to be positioned on the rear side of the ceiling, and is fixed to wooden frame 38.

Subsequently, as illustrated in FIG. 8, adaptor 3 is attached to metal fixture 22, housing 1 inserted through embedding hole 36 is connected to adaptor 3, and housing 1 is fixed to metal fixture 22. Finally, design panel 21 which is not illustrated is disposed over the opening of the bottom surface of housing 1. In such a manner, embedded air blower 20 is installed.

In other words, cushioning 30 includes slits which coincide with the outer periphery of embedding hole 36 for embedding embedded air blower 20. Hence, by drawing a mark along slits 35, it is possible to easily provide an opening for installing a product to the ceiling. This simplifies a work process performed by a construction worker for checking the size of the opening from instructions and marking using a measurer. As a result, a cushioning with an additional function can be used at the time of installation of a product, leading to an increased usability of the cushioning.

(Variation)

Figure 9:
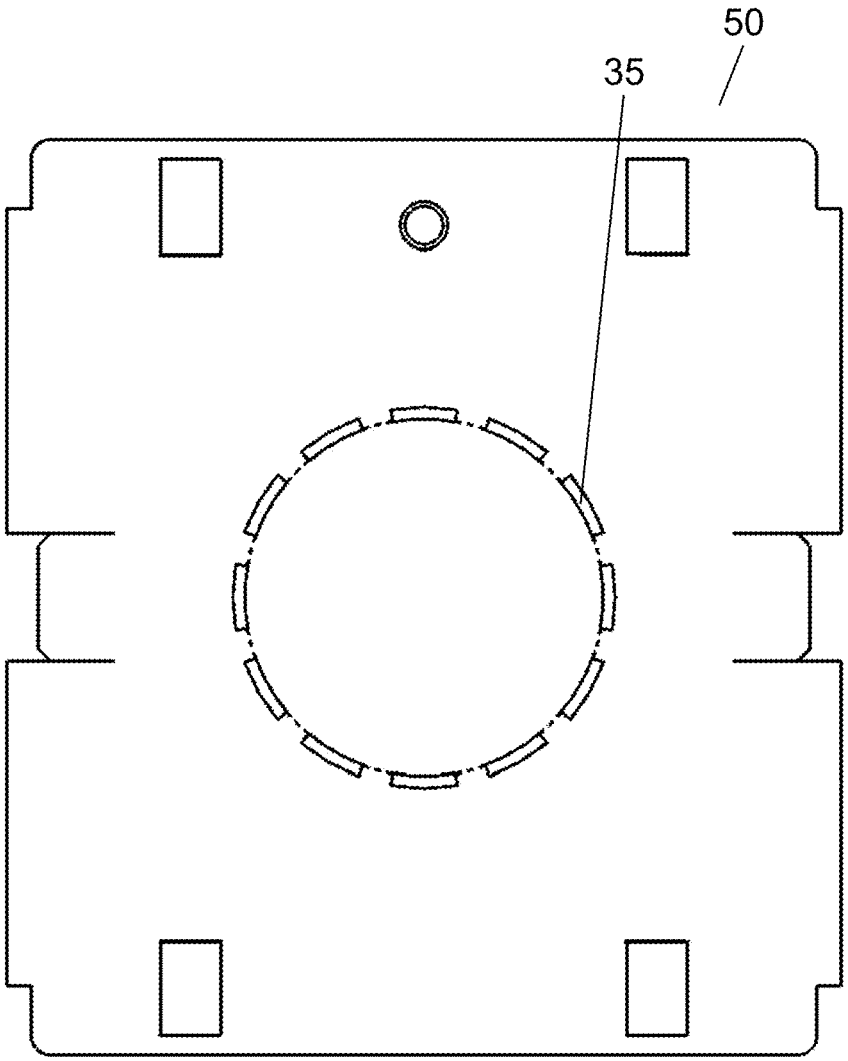
FIG. 9 is a plan view of a cushioning in a developed state according to a variation of the present disclosure.
Figure 10:
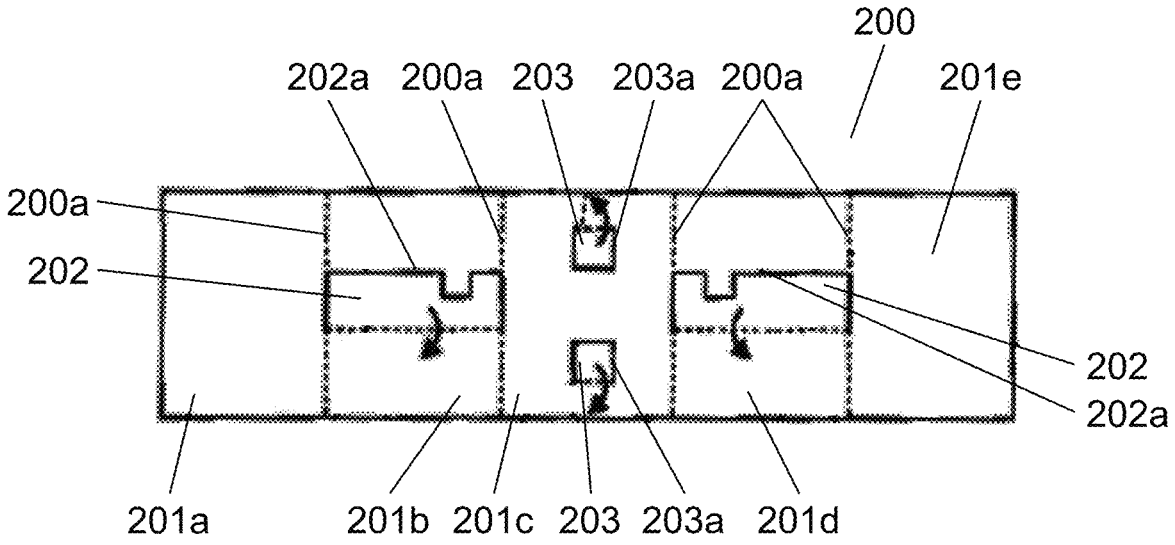
FIG. 10 is a perspective view of a conventional package for a fan.
Figure 11:
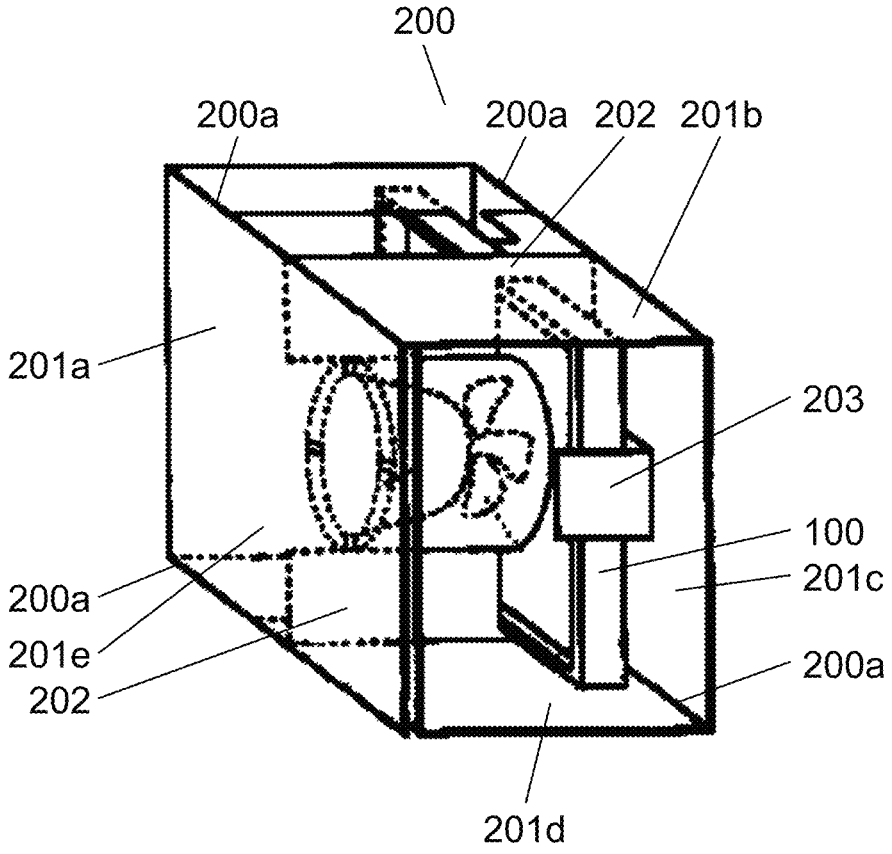
FIG. 11 is a developed view of the conventional package for the fan.

FIG. 9 is an example of cushioning 50 with slits 35 having a circular ring shape. In other words, according to the shape of the embedded air blower, the ring shape of slits 35 of cushioning 50 may have another shape, such as a circular or oval shape.

According to the cushioning in the present disclosure, an opening for installing a product onto the ceiling can be easily provided by drawing a mark along the slits. Hence, the cushioning is used for packaging an embedded air blower, and is also usable as an aid for installation work of the embedded air blower.

What is claimed is:

1. A cushioning configured for packaging an embedded air blower configured to be embedded in a hole in a surface on which the embedded air blower is configured to be installed, the cushioning forming a three-dimensional shape which partially coincides with a shape of the embedded air blower in a packaged state of the embedded air blower, the cushioning forming a planar plate shape defining a plane in an unpackaged state of the embedded air blower, the cushioning comprising:

at least one slit configured to coincide with an outer periphery of the hole, when the cushioning is in the planar plate shape, wherein the at least one slit includes a plurality of slits, each of the plurality of slits being a line-shaped gap penetrating through the plane of the planar plate shape, and short sides of the line-shaped gap are positioned adjacent to each other to have the plurality of slits form a ring shape.

2. The cushioning according to claim 1, wherein a plane of the planar plate shape in the packaged state of the embedded air blower is held by being sandwiched between a first structural component and a second structural component which is different from the first structural component, the first structural component forming a part of the embedded air blower and being disposed on a rear side of the plane, the second structural component being disposed on a front side of the plane which is an opposite side to the rear side.

3. The cushioning according to claim 1, wherein the three-dimensional shape includes a separator which is formed by folding at least part of one side of the planar plate shape in a predetermined angle relative to the plane of the planar plate shape, in the packaged state, the separator separates a first structural component from a second structural component which is different from the first structural component, the first structural component being disposed on a rear side of the plane and on an inner peripheral side of the separator, the first structural component forming a part of the embedded air blower, the second structural component being disposed on a front side of the plane which is an opposite side to the rear side and on an outer peripheral side of the separator.

4. The cushioning according to claim 3, wherein the plane includes a recess on an inner peripheral side relative to the separator, the recess being recessed from the front side to the rear side, and in the packaged state, the recess separates a protrusion from the first structural component, the protrusion protruding from the second structural component toward the inner peripheral side.

5. The cushioning according to claim 1, wherein the ring shape is a circular shape or an oval shape.

6. The cushioning according to claim 1, wherein the ring shape is a rectangular shape.

7. The cushioning according to claim 1, wherein the at least one slit coincides with the outer periphery of the hole such that the hole for installing the product onto a surface can be outlined by drawing a mark along the at least one slit.

* * * * *